US011499345B2

(12) United States Patent
Lai

(10) Patent No.: US 11,499,345 B2
(45) Date of Patent: Nov. 15, 2022

(54) LUGGAGE WITH CASE LOCK FOR SECURING FRONT COVER

(71) Applicant: Wei Hung Lai, Taichung (TW)

(72) Inventor: Wei Hung Lai, Taichung (TW)

( * ) Notice: Subject to any disclaimer, the term of this patent is extended or adjusted under 35 U.S.C. 154(b) by 218 days.

(21) Appl. No.: 17/124,037

(22) Filed: Dec. 16, 2020

(65) Prior Publication Data

US 2022/0186528 A1 Jun. 16, 2022

(51) Int. Cl.

| | |
|---|---|
| ***E05B 65/52*** | (2006.01) |
| ***A45C 5/03*** | (2006.01) |
| ***A45C 13/10*** | (2006.01) |
| ***E05C 1/10*** | (2006.01) |
| ***E05C 1/00*** | (2006.01) |
| ***E05B 37/00*** | (2006.01) |

(52) U.S. Cl.

CPC ..... *E05B 65/5238* (2013.01); *A45C 5/03* (2013.01); *A45C 13/10* (2013.01); *E05C 1/006* (2013.01); *E05C 1/10* (2013.01); *E05B 37/0031* (2013.01); *E05Y 2201/474* (2013.01); *E05Y 2900/602* (2013.01)

(58) Field of Classification Search

CPC ... E05B 65/5238; E05B 37/0031; A45C 5/03; A45C 13/10; E05C 1/006; E05C 1/10; E05Y 2201/474; E05Y 2900/602

See application file for complete search history.

(56) References Cited

U.S. PATENT DOCUMENTS

| | | | | |
|---|---|---|---|---|
| 2,135,905 | A * | 11/1938 | Loftin | E05B 65/44 292/341.11 |
| 2,399,812 | A * | 5/1946 | Ledin | E05B 65/52 70/84 |
| 3,698,753 | A * | 10/1972 | Atkinson | E05C 19/14 70/73 |
| 4,239,269 | A * | 12/1980 | Chiang | E05B 65/5223 292/DIG. 48 |
| 5,060,492 | A * | 10/1991 | Carpenter | E05C 5/00 292/191 |
| 5,216,905 | A * | 6/1993 | Sersch | E05C 19/145 70/73 |
| 6,547,293 | B1 * | 4/2003 | Cheng | E05C 19/14 70/76 |
| 10,231,524 | B2 * | 3/2019 | Tonelli | E05B 65/5269 |

* cited by examiner

*Primary Examiner* — Tri M Mai
(74) *Attorney, Agent, or Firm* — Sinorica LLC

(57) ABSTRACT

A luggage includes a case member having an opening; a front cover connected to the case member to open and close the opening of the case member; a lock member connected to the case member, wherein the lock member has a hook portion, and the hook portion has a bore; a lock base connected to the front cover; a latch movably connected to the lock base; a spring having opposite ends urging the latch and the lock base; and a lever member pivoted lock base and associated with the latch. The latch engages the bore of the hook portion to lock the front cover with the case member, and the lever is turned to move the latch and disengage the latch with the bore of the hook portion of the lock member to unlock the front cover with the case member.

9 Claims, 12 Drawing Sheets

LUGGAGE WITH CASE LOCK FOR SECURING FRONT COVER

BACKGROUND OF THE INVENTION

1. Technical Field

The invention relates to a suitcase or a luggage, and more particularly to a luggage with a case lock for securing a front cover.

2. Description of Related Art

In modern days, people travel a lot for business or tourism, and luggage are the most important good for travelers. A conventional luggage includes a case, a front cover, and zippers. In order to prevent the zippers of the luggage from being broken in transportation, the luggage usually is equipped with a lock, so called TSA Lock.

In spite of the TSA Lock, the zippers are easy to be broken by suitable tools, like screwdriver. As a result, the goods in the luggage may be stolen by breaking the zippers.

BRIEF SUMMARY OF THE INVENTION

In view of the above, the primary objective of the present invention is to provide a luggage with a lock device for securing a front cover, which is capable of firmly securing the luggage.

In order to achieve the objective of the present invention, a luggage includes a case member having an opening; a front cover connected to the case member to open and close the opening of the case member; a lock member connected to the case member, wherein the lock member has a hook portion, and the hook portion has a bore; a lock base connected to the front cover; a latch movably connected to the lock base; a spring having opposite ends urging the latch and the lock base; and a lever member pivoted lock base and associated with the latch.

The latch engages the bore of the hook portion of the lock member to lock the front cover with the case member, and the lever is turned to move the latch and disengage the latch with the bore of the hook portion of the lock member to unlock the front cover with the case member.

In an embodiment, the latch has a protrusion, and the lever member has a driving portion resting against the protrusion, whereby the latch is moved by the lever member through the driving portion and the protrusion.

In an embodiment, the lock base is provided with a through hole, and the driving portion of the lever member passes through the through hole to rest against the protrusion of the latch.

In an embodiment, the lock base has a room and a resting face on a sidewall of the room; the latch and the spring are received in the room, and the spring urges the resting face.

In an embodiment, the latch has a spring hole, in which the spring is received.

In an embodiment, the lock base has two ribs received in the room, and the latch is received between the ribs.

In an embodiment, the lock base has a connecting member, on which the ribs are provided, and the ribs face is located a bottom of the room.

In an embodiment, a lock device is connected to the lever member, wherein the lock base has a locking hole, and the lock device has a locking block to be manipulated for rotation; the locking block is inserted into the locking hole when the lever member is moved toward the lock base, and then the locking block is turned to be locked with the lock base.

In an embodiment, a driving board is movably connected to the lever member, wherein the lock base has a reverse hook portion, and the driving board has a stop portion associated with the reverse hook portion; the stop portion engages the reverse hook portion when the driving board is moved in a direction to lock the lever member with the lock base, and the stop portion disengages the reverse hook portion when the driving board is moved in an opposite direction to unlock the lever member with the lock base.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
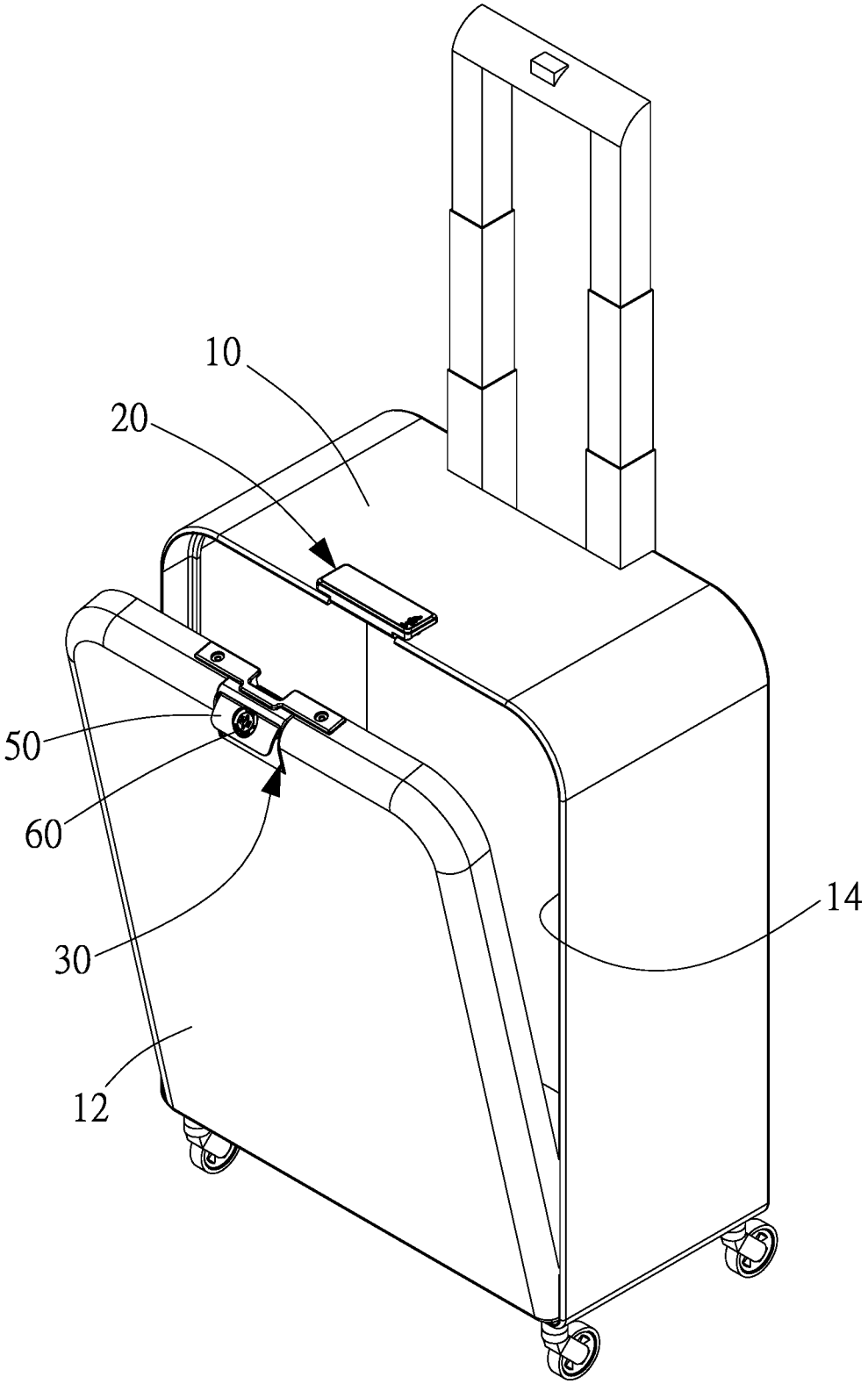
FIG. 1 is a perspective view of a first preferred embodiment of the present invention.

FIG. 1 shows a luggage of the first preferred embodiment of the present invention, including a case member 10 and a front cover 12. The front cover 12 is pivoted on the case member 10 to open or close an opening 14 of the case member 10.

The luggage further includes a case lock to secure the front cover 12 to the case member 10, including a lock member 20 and a lock base 30. The lock member is connected to the case member 10 adjacent to the opening 14 while the lock base 30 is connected to the front cover 12 associated with the lock member 20. The case lock further includes a lever member 50 and a lock device 60, wherein the lever member 50 is pivoted on the lock base 30.

Figure 2:
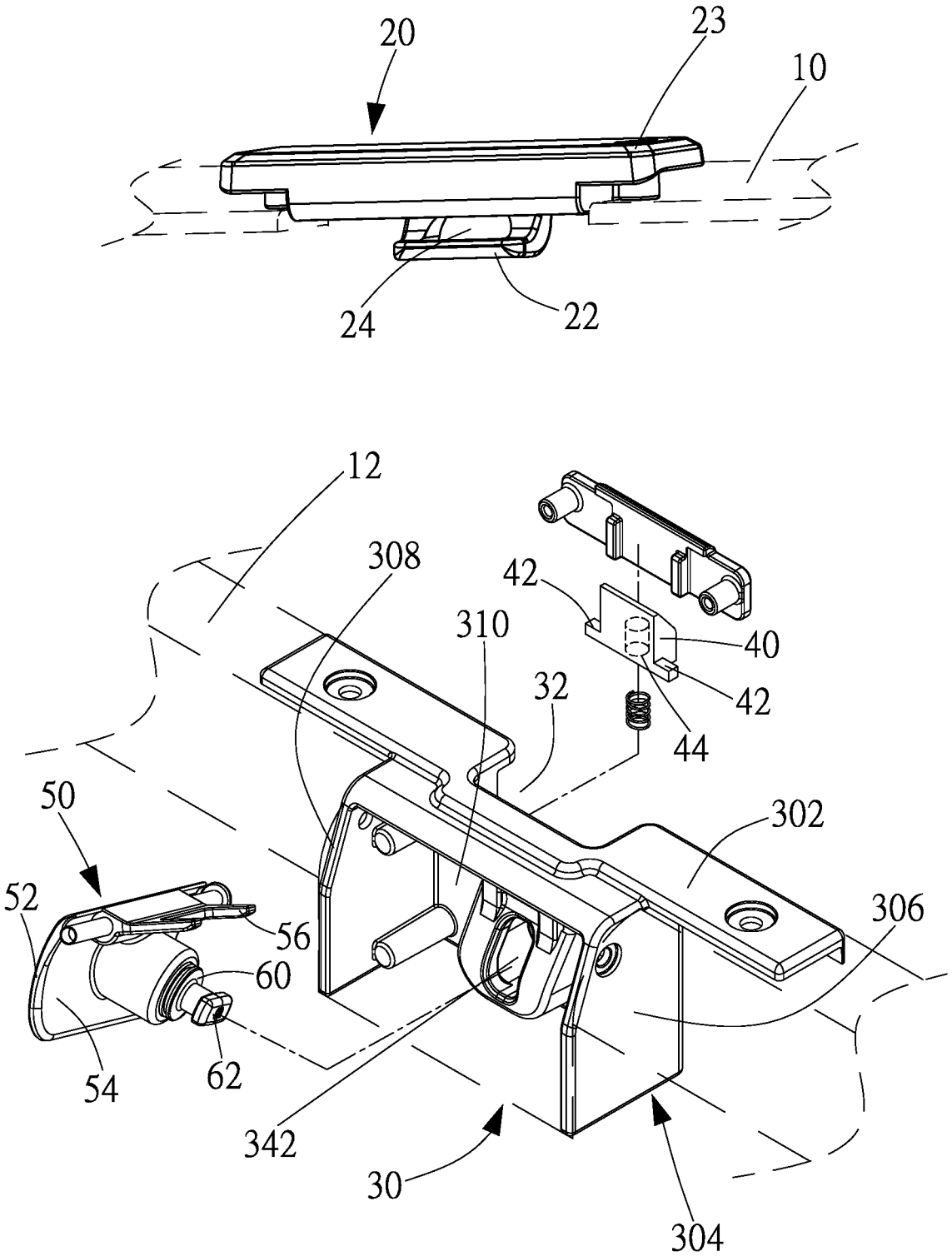
FIG. 2 is an exploded view of the case lock of the first preferred embodiment of the present invention.

As shown in FIG. 2, the lock member 20 includes a hook portion 22 and a connecting board 23. The hook portion 22 is projected from the connecting board 23 and has a bore 24. The connecting board 23 is fixed to the case member 10.

The lock base 30 is fixed to the front cover 12, including a base board 302 and a base member 304 where the base board 302 is connected to a top of the base member 304. The base member 304 includes a first lateral plate 306 and a second lateral plate 308. The first and the second lateral plates 306 and 308 are parallel and kept a predetermined distance from each other. The base member 304 further includes a locking plate 310 having opposite ends connected to the first and the second lateral plates 306 and 308.

Figure 3:
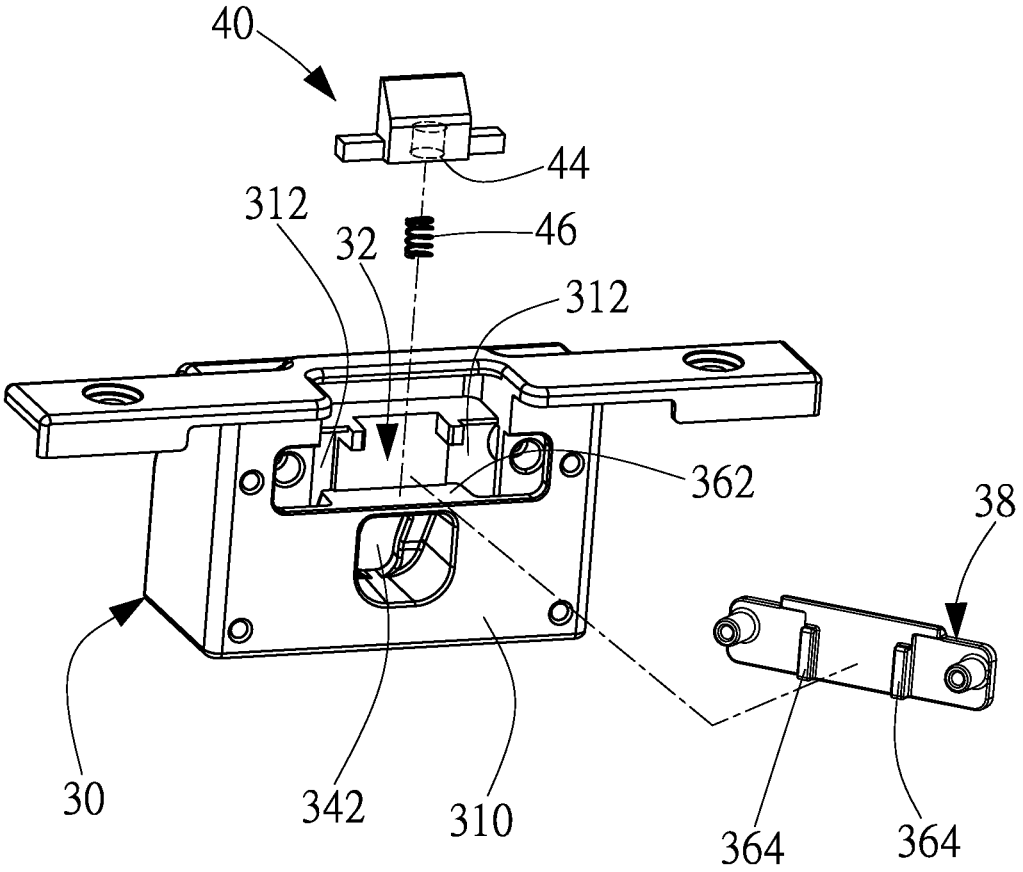
FIG. 3 is another exploded view of the case lock of the first preferred embodiment of the present invention.

As shown in FIG. 2 and FIG. 3, the lock base 30 has a room 32 on a back side of the locking plate 310, and a resting face 362 under the room 32 (FIG. 3). The locking plate 310 is provided with a locking hole 342. The locking hole 342 is under the resting face 362, so that the locking hole 342 is isolated from the room 32. The locking plate 310 further has two through holes 312 communicated with the room 32 (FIG. 3).

The first preferred embodiment further includes a latch 40, having two protrusions 42. The latch 40 is provided with a spring hole 44 with an opening on a bottom of the latch 40.

As shown in FIG. 2, the lever member 50 has a first side 52 and a second side 54 opposite to the first side 52. The lever member 50 has a pair of driving portions 56 on the second side 54. The lock device 60 has a locking block 62 for free rotation. The lock device 60 is fixed to the second side 54 of the lever member 50.

Figure 4:
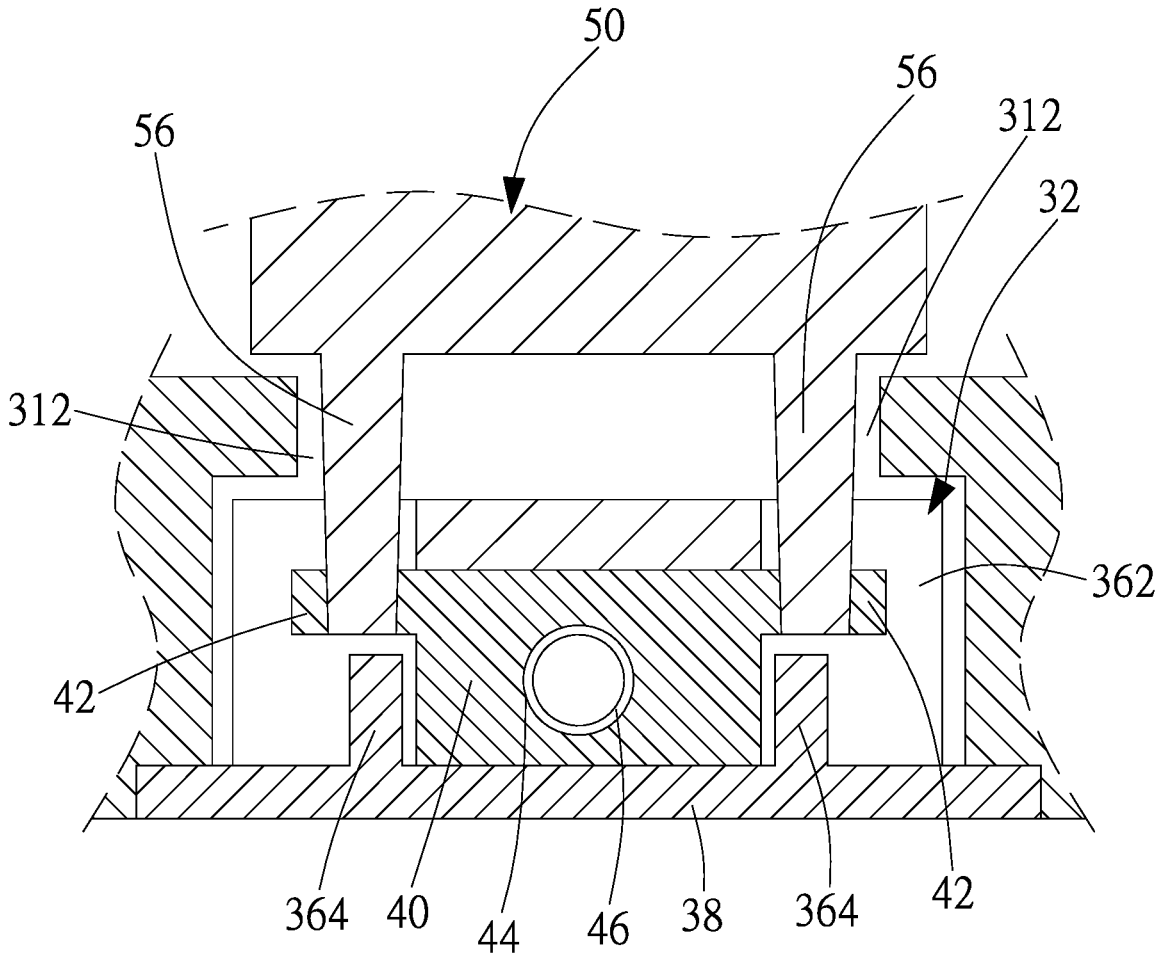
FIG. 4 is a sectional view of the case lock of the first preferred embodiment of the present invention.

As shown in FIG. 3 and FIG. 4, a connecting member 38 has two ribs 364, wherein the ribs 364 are parallel and kept a predetermined distance from each other. The connecting member 38 is received in the room 32 with the ribs 364 facing a bottom of the room 32.

A spring 46 is received in the spring hole 44 of the latch 40. The latch 40 is received in the room 32 of the lock base 30 between the ribs 364 of the connecting member 38 with the spring 46 urging the resting face 362. As a result, the latch 40 is able to be moved by an external force and returned by the spring 46.

Figure 5:
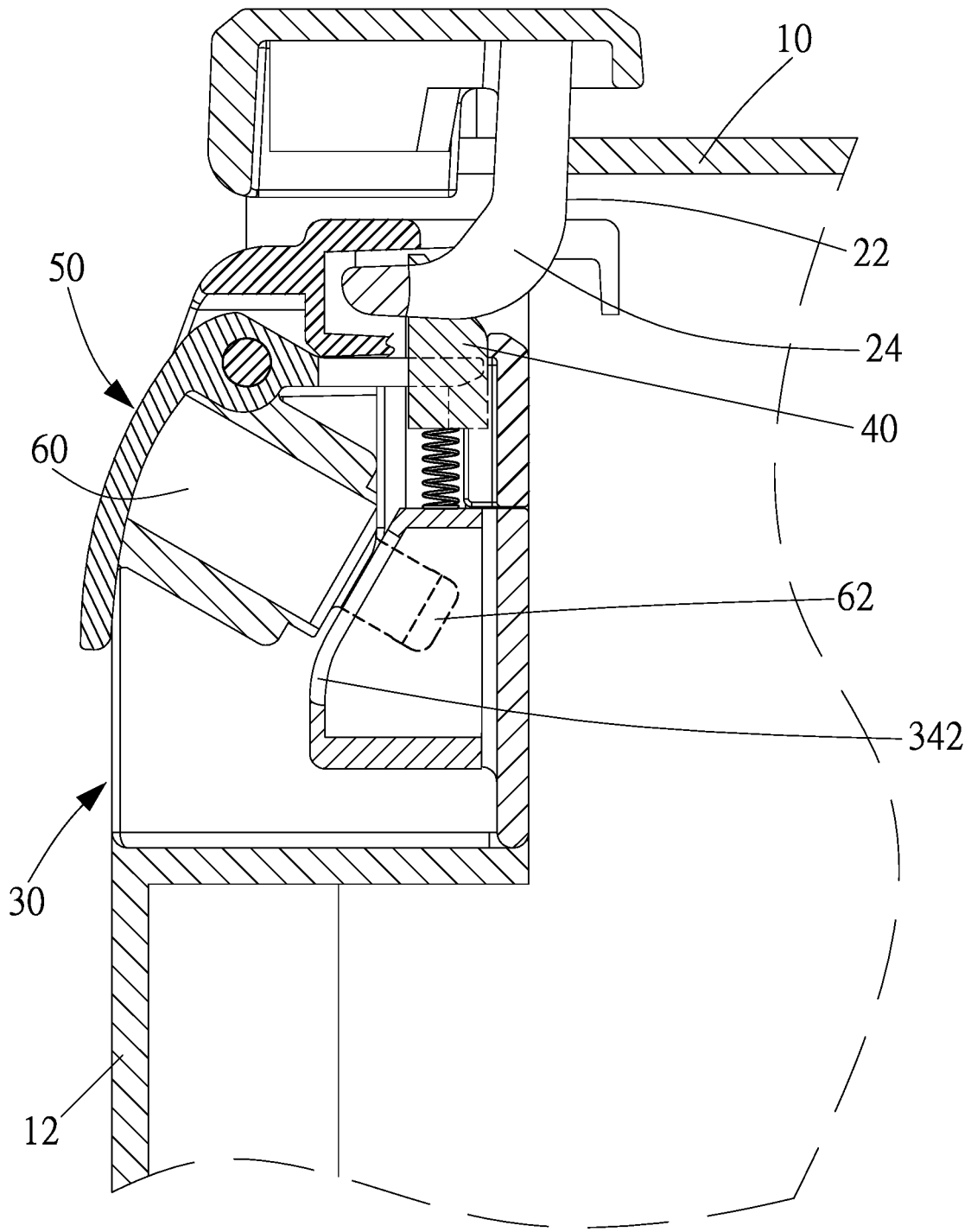
FIG. 5 is a sectional view of the first preferred embodiment of the present invention.

As shown in FIG. 2 and FIG. 5, the lever member 50 and the lock device 60 are installed in the lock base 30. The lever member 50 is pivoted on the lock base 30, and the locking block 62 of the lock device 60 passes through the locking hole 342.

As shown in FIG. 4, the driving portions 56 of the lever member 50 pass through the through holes 312 of the lock base 30 and respectively rest against the protrusions 42 of the latch 40.

As shown in FIG. 2, the locking block 62 is elliptical having a long direction and a short direction, and the locking hole 342 is complementary to the locking block 62, so that the locking block 62 may passes through the locking hole 342 in a predetermined angle, and after that the locking block 62 is secured by turning the locking block 62 as shown in FIG. 5. As a result, the lock device 60 is locked with the lock base 30 to secure the front cover 12 with the case member 10. In this condition, the latch 40 is inserted into the bore 24 of the hook portion 22 of the lock member 20.

Figure 6:
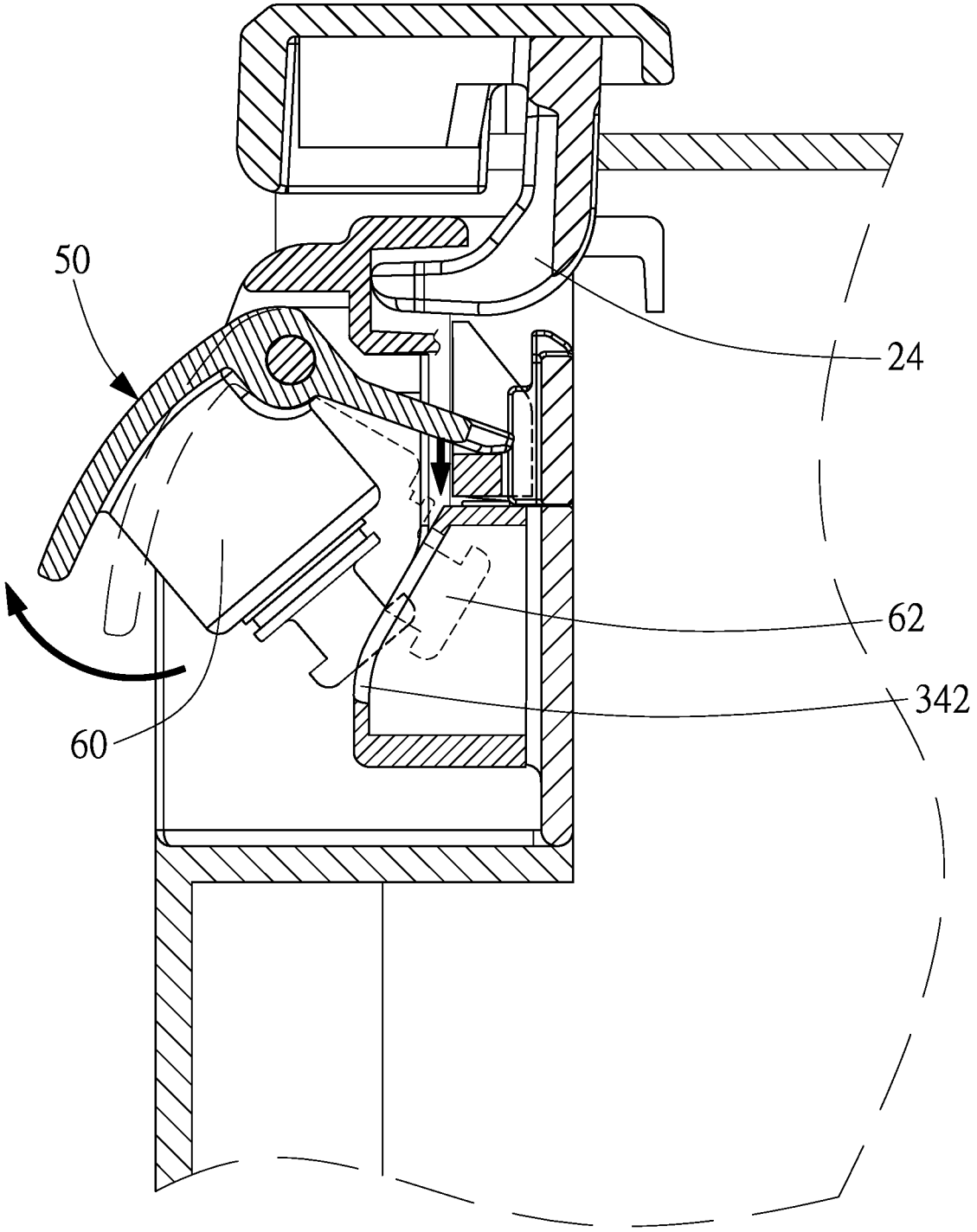
FIG. 6 is a sectional view of the first preferred embodiment of the present invention, showing how the case lock in operation.
Figure 7:
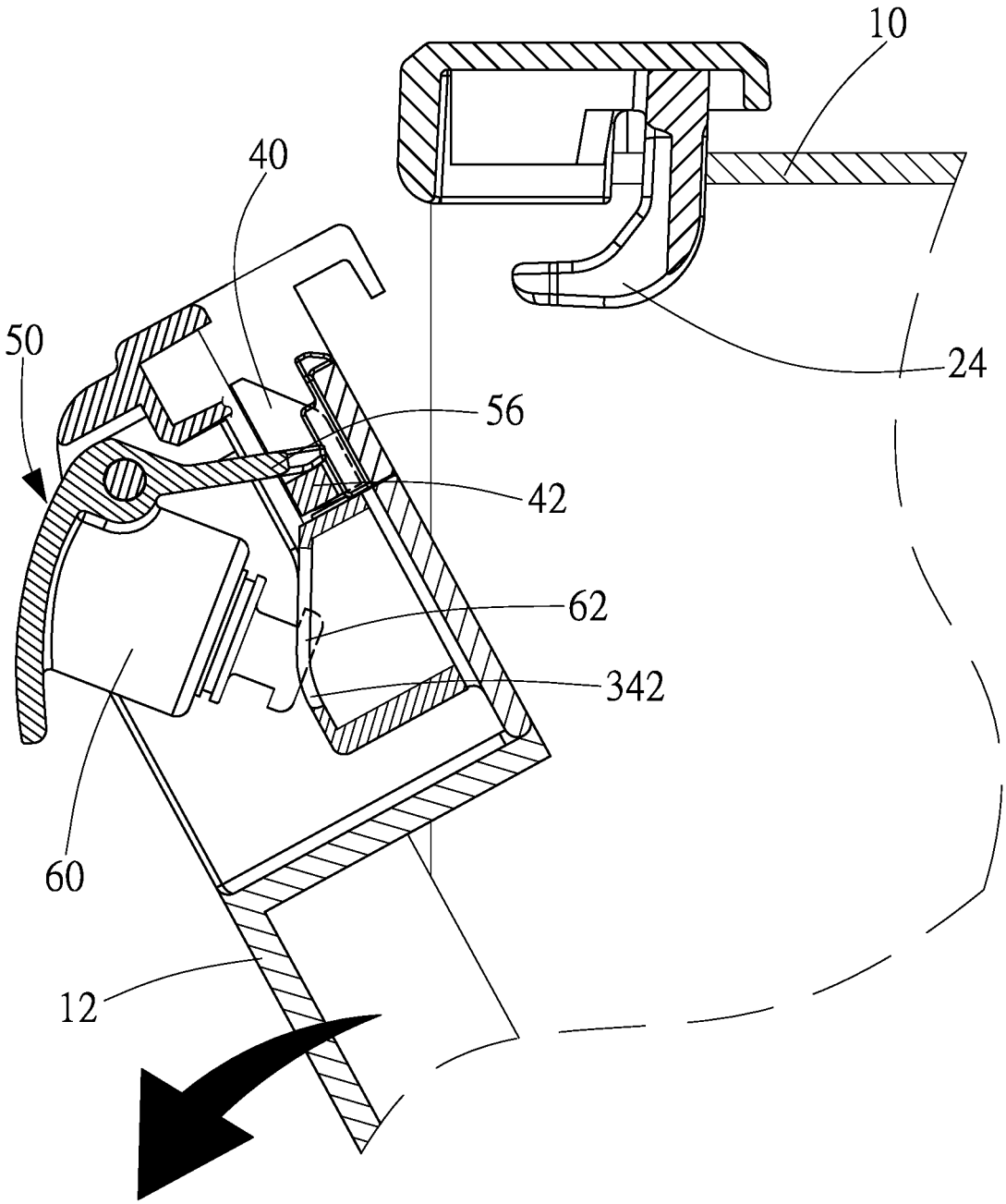
FIG. 7 is a sectional view of the first preferred embodiment of the present invention, showing how the case lock in operation following FIG. 6.

As shown in FIG. 6, the lock device 60 is unlocked when the locking block 62 is turned back to the predetermined angle and the locking block 62 is pulled out of the locking hole 342 by turning the lever member 50. As shown in FIG. 7, when turning the lever member 50, the driving portions 56 press the protrusions of the latch 40 to move the latch 40 off the bore 24. Next, user may move the front cover 12 to open the luggage.

In conclusion, user may move the front cover 12 against the case 10, then the hook portion 22 may cross the latch 40 to let the latch 40 engage the bore 24 because of the spring 46, and the locking block 62 is inserted into the locking hole 342. The front cover 12 is locked with the case member 10 when the lock device 60 is turned. To unlock the luggage, the lock device 60 is turned back to the predetermined angle, and then the lever member 50 is turned to disengage the latch with the hook portion 22 of the lock member 20 that the user may open the front cover 12.

Figure 8:
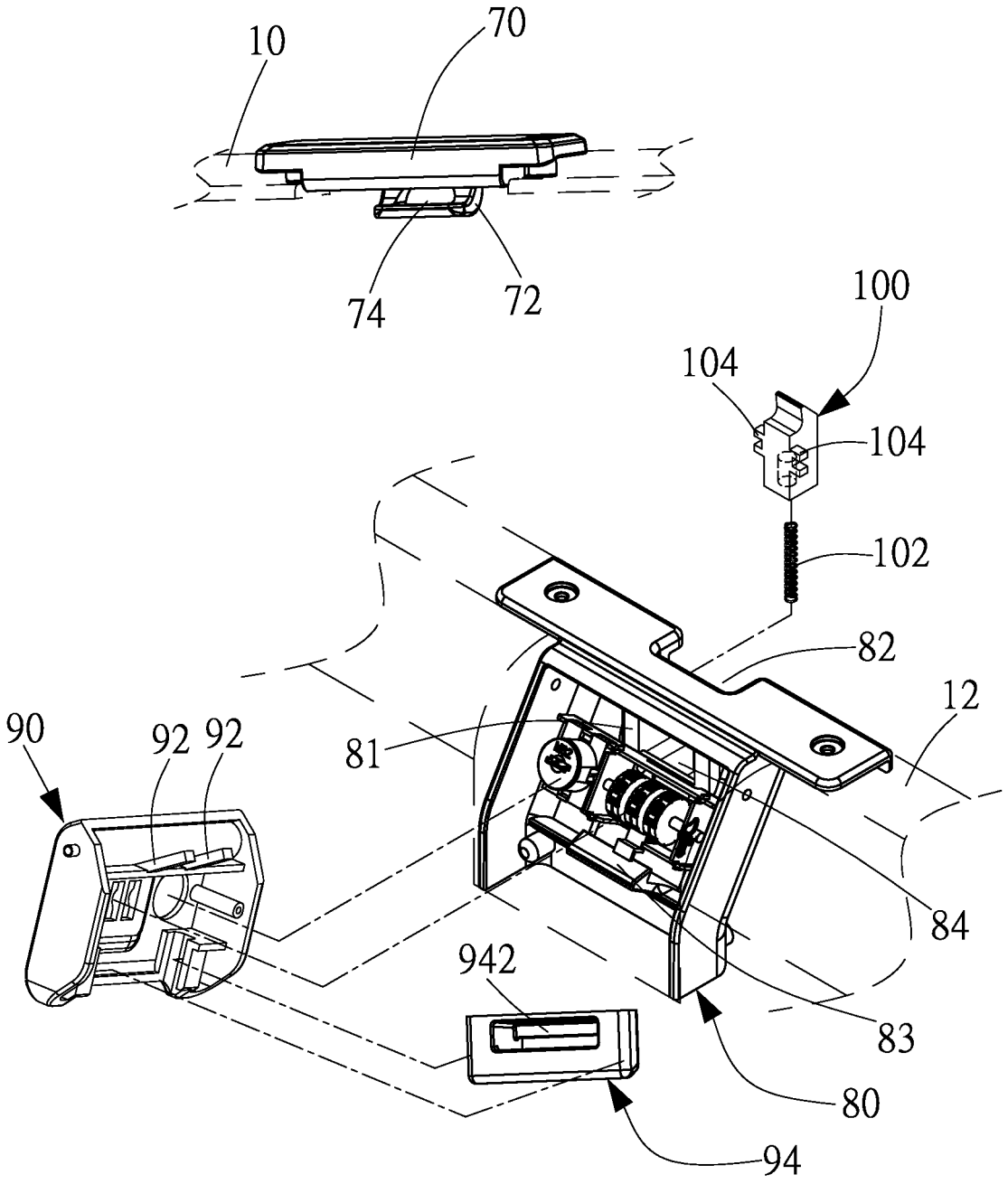
FIG. 8 is an exploded view of the case lock of a second preferred embodiment of the present invention.

FIG. 8 shows a luggage of the second preferred embodiment of the present invention, includes a lock member 70, a lock base 80, and a lever member 90. These elements are the same as the first preferred embodiment, so I do not describe them again.

Figure 9:
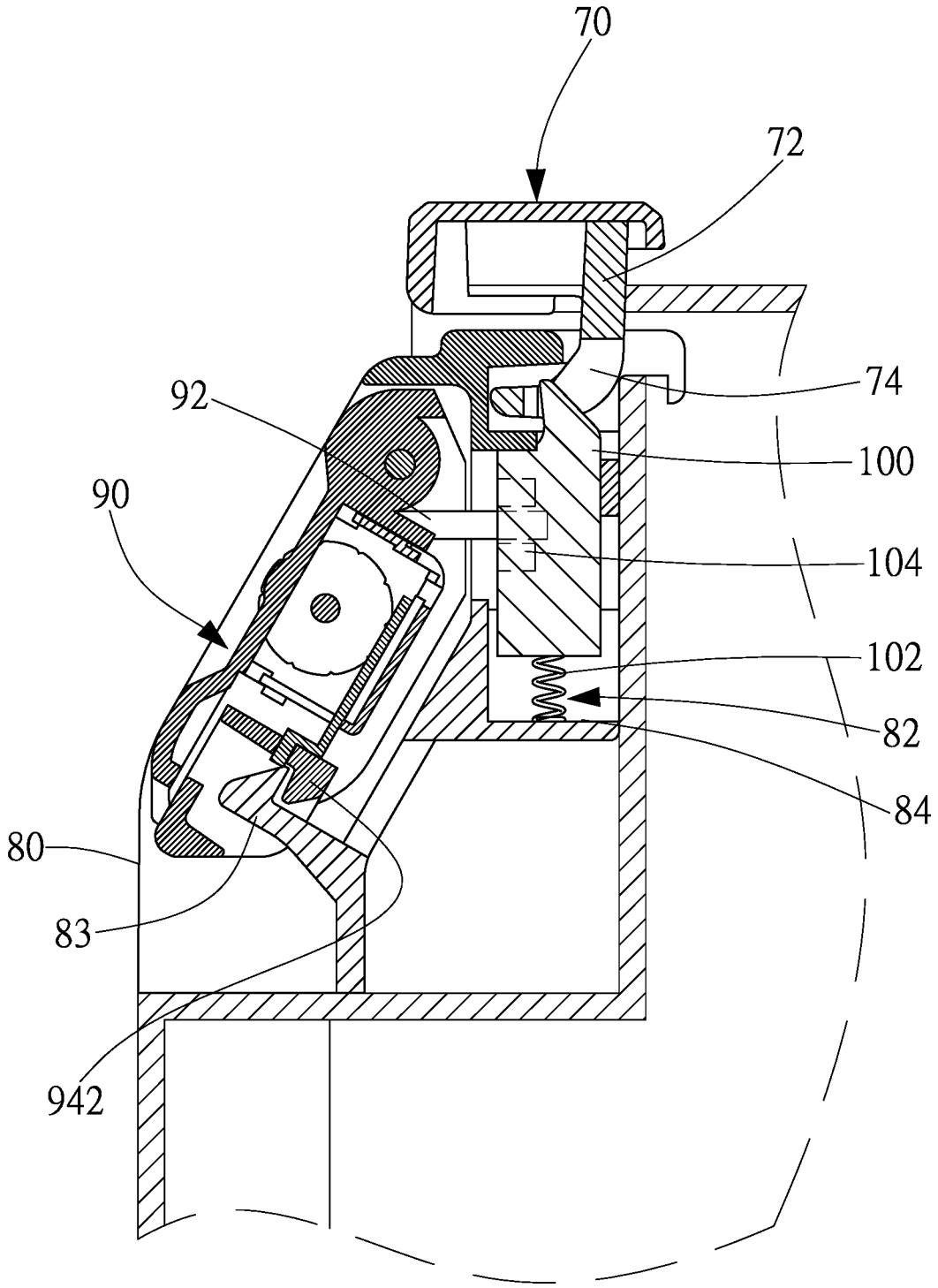
FIG. 9 is a sectional view of the second preferred embodiment of the present invention.

As shown in FIG. 8 and FIG. 9, the lock member 70 has a hook portion 72 with a bore 74 thereon. The lock base 80 has a room 82 with a resting face 84 on a lower sidewall. A latch 100 and a spring 102 are received in the room 82 with the spring 102 having opposite ends urging the resting face 84 and the latch 100. The latch 100 has two protrusions 102, and the lever member 90 has two driving portions 92.

The lever member 90 is pivoted on the lock base 80 with the driving portions 92 passing through a through hole 81 of the lock base 80 and resting against the protrusions 102.

The lock base 80 of the second preferred embodiment further has a reverse hook portion 83. The second preferred embodiment further includes a driving board 94, having a stop portion 942. The driving board 94 is connected to the lever member 90 with the stop portion 942 engaging the reverse hook portion 83, so that the lever member 90 is locked and unable to turn.

Figure 10:
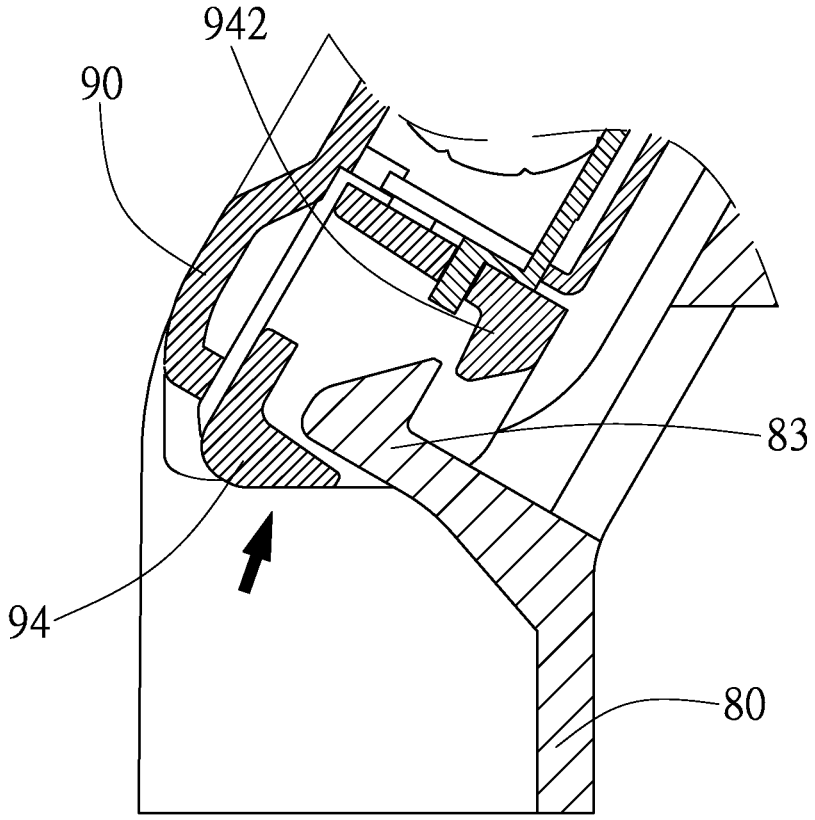
FIG. 10 is a sectional view of the second preferred embodiment of the present invention, showing how the case lock in operation.
Figure 11:
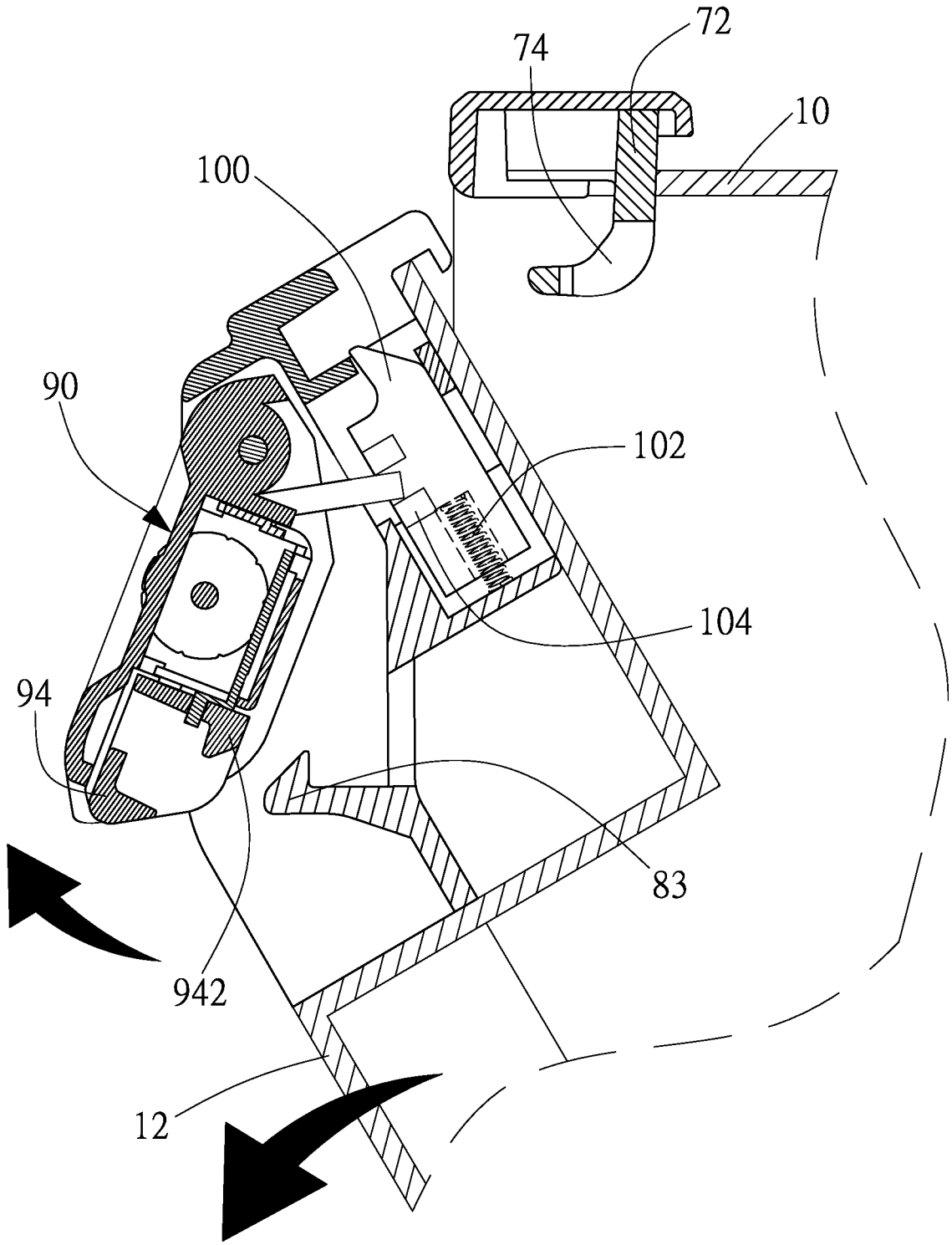
FIG. 11 is a sectional view of the second preferred embodiment of the present invention, showing how the case lock in operation following FIG. 10.

As shown in FIG. 10, push the driving board 94 may disengage the stop portion 942 with the reverse hook portion 83 of the lock base 80. As a result, the lever member 90 is free to turn. Next, as shown in FIG. 11, turn the lever member 90 may make the driving portions 92 press the protrusions 104 to disengage the latch 100 with the bore 74 of the hook portion 72, and then the front cover 12 is opened.

Figure 12:
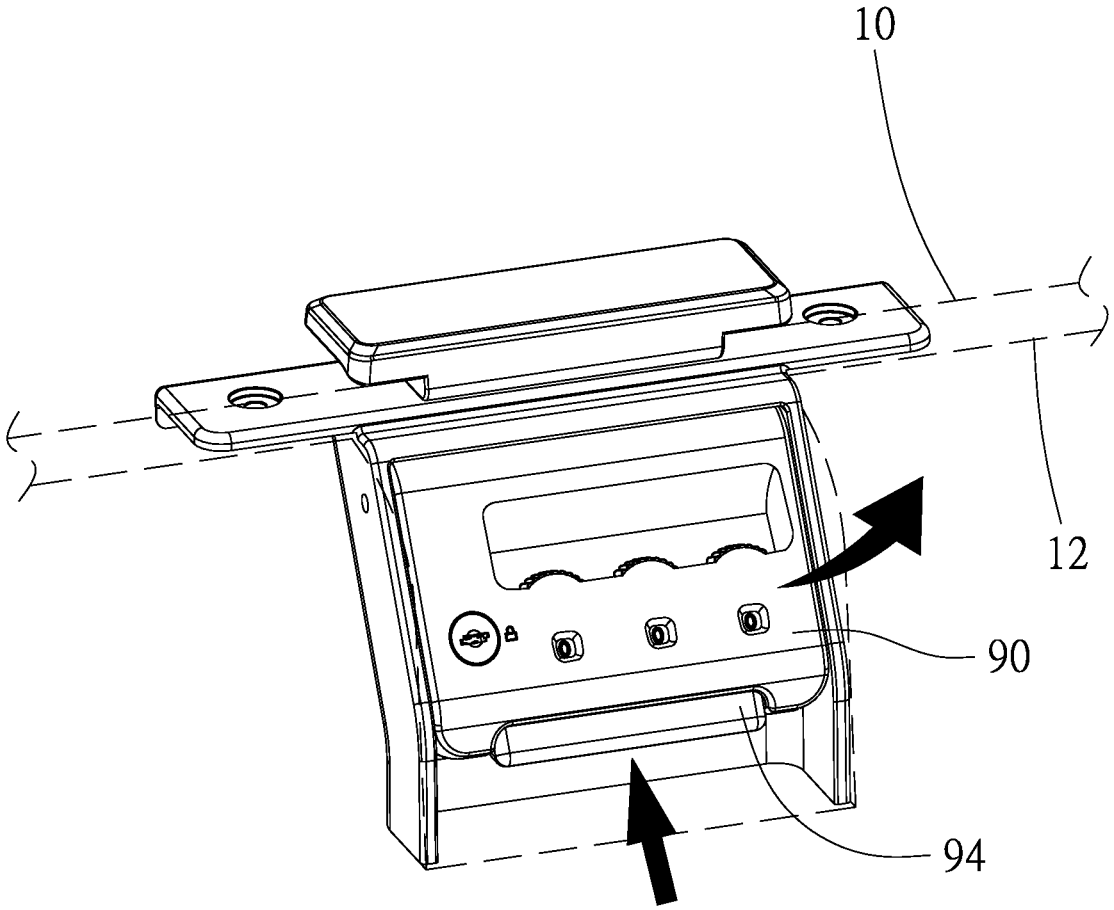
FIG. 12 is a perspective view of the case lock of a third preferred embodiment of the present invention.

FIG. 12 shows a luggage of the third preferred embodiment of the present invention, which is the same as the second preferred embodiment, except that under unlock condition, the driving board 94 is moved toward the lever member 90, and the lever member 90 is forced to open the front cover 12.

It must be pointed out that the embodiments described above are only some preferred embodiments of the present invention. All equivalent structures which employ the concepts disclosed in this specification and the appended claims should fall within the scope of the present invention.

What is claimed is:

1. A luggage, comprising:

a case member having an opening;

a front cover connected to the case member to open and close the opening of the case member;

a lock member connected to the case member, wherein the lock member has a hook portion, and the hook portion has a bore;

a lock base connected to the front cover;

a latch movably connected to the lock base;

a spring having opposite ends urging the latch and the lock base; and a lever member pivoted lock base and associated with the latch;

wherein the latch engages the bore of the hook portion of the lock member to lock the front cover with the case member;

wherein the lever is turned to move the latch and disengage the latch with the bore of the hook portion of the lock member to unlock the front cover with the case member.

2. The luggage of claim 1, wherein the latch has a protrusion, and the lever member has a driving portion resting against the protrusion, whereby the latch is moved by the lever member through the driving portion and the protrusion.

3. The luggage of claim 2, wherein the lock base is provided with a through hole, and the driving portion of the lever member passes through the through hole to rest against the protrusion of the latch.

4. The luggage of claim 1, wherein the lock base has a room and a resting face on a sidewall of the room; the latch and the spring are received in the room, and the spring urges the resting face.

5. The luggage of claim 4, wherein the latch has a spring hole, in which the spring is received.

6. The luggage of claim 4, wherein the lock base has two ribs received in the room, and the latch is received between the ribs.

7. The luggage of claim 6, wherein the lock base has a connecting member, on which the ribs are provided, and the ribs face is located a bottom of the room.

8. The luggage of claim 1, further comprising a lock device connected to the lever member, wherein the lock base has a locking hole, and the lock device has a locking block to be manipulated for rotation; the locking block is inserted into the locking hole when the lever member is moved toward the lock base, and then the locking block is turned to be locked with the lock base.

9. The luggage of claim 1, further comprising a driving board movably connected to the lever member, wherein the lock base has a reverse hook portion, and the driving board has a stop portion associated with the reverse hook portion; the stop portion engages the reverse hook portion when the driving board is moved in a direction to lock the lever member with the lock base, and the stop portion disengages the reverse hook portion when the driving board is moved in an opposite direction to unlock the lever member with the lock base.

* * * * *